United States Patent [19]

Diehl et al.

[11] Patent Number: 5,050,680

[45] Date of Patent: Sep. 24, 1991

[54] ENVIRONMENTAL PROTECTION FOR SUBSEA WELLS

[75] Inventors: Robert J. Diehl, Wallis; Roger S. Osborne, Houston; Jeff Elwood, Missouri City, all of Tex.

[73] Assignee: Cooper Industries, Inc., Houston, Tex.

[21] Appl. No.: 496,683

[22] Filed: Mar. 21, 1990

[51] Int. Cl.[5] ..... E21B 43/01; E02D 29/00

[52] U.S. Cl. ..... 166/356; 166/364; 405/211; 405/60; 137/312

[58] Field of Search ..... 166/351, 356, 363, 364, 166/368, 97; 405/211, 60, 65; 137/312; 210/170, 922, 923

[56] References Cited

U.S. PATENT DOCUMENTS

| | | | |
|---|---|---|---|
| 2,766,614 | 10/1956 | Cook | 285/171 |
| 3,339,512 | 9/1967 | Siegel | 166/351 |
| 3,592,263 | 7/1971 | Nelson | 166/351 |
| 3,610,194 | 10/1971 | Siegel | 137/312 |
| 3,643,447 | 2/1972 | Pogonowksi | 166/351 |
| 3,756,294 | 9/1973 | Rainey | 405/65 |
| 3,802,456 | 4/1974 | Wittgenstein | 285/93 |
| 4,283,159 | 8/1981 | Johnson et al. | 405/211 |
| 4,408,628 | 10/1983 | Monk | 137/312 |
| 4,456,071 | 6/1984 | Milgram | 166/364 |

FOREIGN PATENT DOCUMENTS

| | | | |
|---|---|---|---|
| 8201387 | 4/1982 | World Int. Prop. O. | 405/60 |

OTHER PUBLICATIONS

W-K-M Wellhead Equipment, Catalog 1986, Cover and p. 84.

*Primary Examiner*—Bruce M. Kisliuk

*Attorney, Agent, or Firm*—William E. Shull; David A. Rose; Ned L. Conley

[57] ABSTRACT

An enclosed protective chamber for a subsea wellhead assembly includes a main body installed on the sea floor. Subsea wellhead apparatus is mounted in the chamber on top of a well. A pressure-containing lid is mounted on and sealed with respect to the main body such that chamber pressure is isolated from the subsea hydrostatic head. An inflatable, elongated, flexible storage tank or dracon is attached to the chamber through a conduit having a pressure-balanced relief valve therewithin. The dracon is attached to the conduit through a quick disconnect coupling and closure valve which permit ready attachment, removal, or replacement of the dracon. Under normal operating conditions the dracon is deflated. The dracon is preferably anchored to the sea floor. When a leak in the subsea wellhead assembly occurs, excess chamber pressure permits surplus fluid to enter and fill the dracon. The dracon may then be disconnected from the conduit, the anchor released, and the dracon removed to the surface for retrieval or disposal of the fluid contents. Substantially no well or chamber fluids are released into the sea during the dracon removal and reinstallation processes. A pop-off cap and expandable conduit may be mounted on top of the chamber.

26 Claims, 7 Drawing Sheets

ENVIRONMENTAL PROTECTION FOR SUBSEA WELLS

BACKGROUND OF THE INVENTION

The present invention relates generally to production of oil or gas from subsea wells, and more particularly to an environmentally protective enclosure system for a subsea wellhead which is adapted to contain leakage from the wellhead for later retrieval or conveyance to the surface of the sea.

In the underwater production of oil and gas, it is not uncommon for wells to be located in areas of high oceangoing traffic, wherein the subsea production apparatus is subject to being impacted and damaged by passing foreign objects such as anchors or anchor cables, or ensnared in nets, lines, and the like. Sometimes such offshore wells are located in areas where the ocean floor is less cohesive, and where sand, mud, silt, and the like are more likely to shift due to currents or other disturbances and become deposited in or upon the subsea production apparatus. In addition to the foregoing hazards of subsea production, the natural environment of the well location may be unduly corrosive, or the natural marine life may be such as to unduly foul or otherwise interfere with the subsea apparatus or operations. Any of these hazards could result in impairment or damage severe enough to require repair or replacement of the affected equipment before production operations would be allowed to resume. For offshore installations, such repairs or equipment replacement operations can often be extremely difficult, time-consuming, and expensive, and quite possibly dangerous to divers or others at the water's surface.

In order to avoid or minimize the effects of the foregoing hazards at offshore production locations, protective enclosures or silos have been used in the past to enclose subsea wellhead and Christmas tree structures disposed adjacent or below the ocean floor. Such a silo is typically a hollow cylindrical structure which is drilled, driven, jetted, or washed into the sea floor around the well location. A conductor guide casing string may be attached to the lower end of the cylindrical silo structure, and may extend into the ocean floor for a distance of several hundred feet or more. Drilling or other operations are conducted through the conductor guide casing, and when the well is completed, the wellhead equipment, Christmas tree, and valve controllers or operators may be installed within the surrounding silo. A removable cover may then be installed on top of the silo, sealed with respect to the silo's sidewalls, and equipped with means allowing the interior of the silo to be filled with corrosion and marine life inhibiting fluids, and permitting evacuation of such fluids and temporary replacement, for example, with clear, filtered sea water for monitoring repair operations or the like. Silo systems such as these may be installed so as to have a very low profile with respect to the sea floor, with substantially only their covers and landing flanges protruding above the mudline. In this configuration, the wellhead apparatus enclosed within the silo is substantially entirely protected from being impacted by foreign objects traveling through the water in the vicinity of the well. The wellhead equipment is also separated and protected from any adjacent unstable sea floor material, so that sand, mud, and silt cannot accumulate on the equipment. Moreover, the corrosion and marine life inhibitors filling the silo prevent damage to or impairment of the wellhead apparatus from those two sources. Since the silo itself is a very low-profile installation, there is little chance that it would sustain any direct hits by passing foreign objects, or become ensnared in nets, cables, or the like, such as would impair or damage its protective function. Thus, wellhead equipment installed in such a silo is substantially free of the hazards first discussed above. An example of such a silo system is disclosed in U. S. Pat. No. 3,592,263, issued July 13, 1971, to Norman A. Nelson. Another such silo system is disclosed in a catalog of W-K-M, then a division of Joy Manufacturing Company but now owned by Cooper Industries, Inc., the assignee of the present application, entitled *W-K-M Wellhead Equipment* and bearing a copyright notice date of 1986, at page 84.

Sometimes it is necessary or desirable to install a silo around an existing subsea wellhead or Christmas tree structure which protrudes above the ocean floor. In that event, the silo when installed will not be as low profile as those discussed above, but by constructing a berm or other protective embankment or structure around the silo, the possibility of the silo's being struck by oceangoing traffic or ensnared in nets or anchor lines, as discussed above, is minimized.

Although the silo systems discussed above have been found suitable for enclosing and protecting subsea wells under normal operating conditions from the hazards referred to, from time to time leaks can develop from the contained wellhead apparatus, and the prior art silo systems were not designed or intended to contain leakage of petroleum products and prevent their disbursement into the surrounding subsea environment. As a result, a substantial quantity of crude oil or the like may seep or flow from the well and the silo before the leak can be detected and repaired. This leakage can be extremely harmful to the environment, not only to the surrounding subsea environment, but also to that on the ocean's surface and on beaches or other areas where the stray oil makes its landfall. Fish, aquatic birds and mammals, and plant life can all be adversely affected or destroyed. Cleanup costs can be staggering. Even with proper cleanup procedures, the adverse effects of subsea oil leakage can linger for years. Of course, the costs associated with environmental pollution from a leaking subsea well are in addition to the costs associated with the value of the lost production which, depending on the rate of leakage and the time it takes for detection and repair, may be substantial.

One approach which has been proposed in the past for preventing contamination of the environment from oil leakage from a submerged container is illustrated in U.S. Pat. No. 3,756,294, issued Sept. 4, 1973, to Rainey. The Rainey patent discloses an elongated, flexible and impervious conduit having an inverted channel-shaped mouth made of cushioning sealing material and flexible magnetic materials for attaching the mouth of the flexible conduit to the submerged container, such as a ship or tank, around the source of the leakage. The flexible conduit is open at the bottom for permitting entry of water into the conduit to float the entrapped oil and accelerate its passage upwardly through the conduit. The entrapped oil is conveyed through the conduit to a floating bladder or other container at the surface of the sea. While the Rainey apparatus may be suitable for conveying oil leakage, once detected, from a tanker or submerged storage facility to the surface to alleviate further environmental damage from the leakage, it is not suitable for containing leakage from a subsea wellhead for later retrieval or conveyance to the surface, and for preventing environmental damage from subsea wellhead leakage. The Rainey system is not pressure-containing, and for that reason alone it would not be suitable for subsea wellhead use, where leaking fluids can be under considerable pressures. Furthermore, the Rainey apparatus is not designed or intended to be part of a permanent subsea installation. It is only for the purpose of collecting leaking oil after the leak is detected, which might not be until after a substantial quantity of oil has leaked out and substantial environmental damage has already occurred. Moreover, the Rainey system would be unsuitable for permanent installation, since the elongated flexible conduit connected to the floating bladder would interfere with oceangoing traffic and the like and would comprise more of an obstacle than the subsea wellhead apparatus, even without the protective silo enclosures discussed above.

Flexible containment devices have also been proposed for containing potentially environmentally hazardous fluids within leaking storage tanks or the like, and preventing such fluids from contaminating ground water. In U.S. Pat. No. 4,408,628, issued Oct. 11, 1983, to Monk, there is disclosed a flexible, fluid tight liner placed inside a leaking storage tank to prevent the contained fluids from contacting the interior of the tank. The liner is initially collapsed but is expandable, with fluid volume, to the internal dimensions of the tank. Such a liner is designed to retain the fluids inside the tank, and is not capable of being removed from the tank with the fluids retained therein for transporting the fluids to a remote location. Thus, such an internal liner is not suitable for containing leakage from the wellhead apparatus of a subsea well, wherein the leaking well fluids must be both contained and transported to a location remote from the well, preferably at the surface of the water. Moreover, it would be extremely impractical, if not altogether impossible, to place such a liner within the bore(s) of a subsea wellhead and Christmas tree assembly in order to block with the liner all possible avenues of leakage.

Other externally applied devices and apparatus for detecting and/or containing leakage of fluids from pipelines or other conduits have been proposed, such as the pipe wraps or jacketing devices disclosed in, for example, U.S. Pat. No. 3,802,456, issued Apr. 9, 1974, to Wittgenstein, and U.S. Pat. No. 2,766,614, issued Oct. 16, 1956, to Cook. Such wrapping devices cannot be placed on subsea wellhead and Christmas tree apparatus, however, with its multiplicity of flow conduit and piping sizes, flanges, fittings, valves, and the like, and moreover, such wrapping devices do not permit the stored or contained leakage to be conveyed to a remote location for appropriate use or disposal.

It is an object of the present invention to overcome the problems associated with the prior art underwater leakage containment devices referred to above, and the inapplicability of the other various leakage containment means such as liners and pipe wraps to subsea wellhead systems, by providing apparatus and methods for containing leakage from a subsea well for later retrieval or conveyance to the surface of the sea. It is another object of the present invention to provide such a subsea wellhead leakage containment system which may be permanently installed at the wellhead site on the sea floor while minimizing the risks of its being impacted and damaged by passing foreign objects or interfering with oceangoing traffic or other marine operations.

It is another object of the present invention to provide such a subsea wellhead leakage containment system which traps and contains leaking oil or the like before it has escaped from the confines of the system, and before it has had an opportunity to adversely affect the environment.

It is another object of the present invention to provide a subsea wellhead leakage containment system having secondary leakage containment means which continues to contain surplus fluids when the primary leakage containment means has reached its capacity. It is also an object of the present invention to provide such a secondary leakage containment means which alerts operators at the water's surface when the primary leakage containment means has reached its capacity. It is also an object of the present invention to delay release of any leaking petroleum products into the surrounding environment until after the primary and secondary leakage containment means have reached their capacities. It is a further object of the present invention to permit operators at the water's surface to locate relatively quickly and easily the leaking well in the event the leakage containment system's capacity is reached, and to permit relatively rapid connection of an alternative or additional leakage containment system in order to minimize leakage of petroleum products into the environment.

It is another object of the present invention to provide such a subsea wellhead leakage containment system which is simple and inexpensive to manufacture and install, reliable, and durable, being made of tough, flexible, substantially corrosion-resistant materials.

SUMMARY OF THE INVENTION

The present invention accomplishes the objectives referred to above by providing an enclosed protective chamber having an elongated main body of substantially hollow cylindrical configuration which may be drilled, driven, jetted, or washed into the sea floor. A conductor guide casing attached to the bottom of the main body is installed along with it. The conductor guide casing extends a substantial distance further into the seabed. A well is drilled from a platform or vessel above the protective chamber, through the bottom of the main body and down through the conductor guide casing. Upon completion of drilling operations, the subsea wellhead apparatus, Christmas tree, and tree valve controllers or operators are installed on top of the well in the main body portion of the protective enclosure. A pressure-containing lid is secured in place on top of the main body by L-shaped lugs on the lid or the main body which are received in correlatively-shaped slots on the other member. A hydraulic locking device locks the lid onto the main body. An inflatable seal located between the top lid and the main body seals internal pressure from the hydrostatic head of the surrounding sea water. Alternatively, an enclosed protective chamber may be installed around a wellhead or Christmas tree structure which is already located on the sea floor on an existing well. In that event, the protective chamber will typically protrude above the surrounding seabed.

An inflatable, elongated, flexible storage tank or dracon is attached to the protective enclosure through a fluid carrying conduit incorporating a pressure-balanced relief valve therewithin. The dracon is attached to the conduit via a quick disconnect-type coupling. A closure valve which is actuated to closed position upon release of the quick disconnect coupling is disposed in the conduit at the coupling location. The quick disconnect coupling and closure valve permit ready attachment, removal, or replacement of the dracon. Several outlets are provided in the conduit to allow coupling to a tanker, for example, or simultaneous filling of two or more dracons. Under normal operating conditions, the dracon is deflated, and may be outstretched on the sea floor adjacent to the protective enclosure. Alternatively, it may be rolled or folded up, somewhat like an empty fire hose or inflatable life raft would be in storage.

In the event of a leak developing from the subsea wellhead apparatus within the enclosed chamber, a pressure buildup within the chamber allows surplus fluid to be communicated to the dracon through the conduit, pressure relief valve, closure valve, and quick disconnect coupling. When the dracon is filled, it may be disconnected from the conduit and removed to the surface for retrieval or disposal of the fluid contents.

A connection may be provided on top of the lid of the protective chamber to permit attachment of a riser pipe from the chamber to a vessel or fixed structure at the surface prior to opening a wireline access hatch. Wireline or other operations may then proceed through the riser pipe and access hatch.

The interior of the protective chamber is filled with a corrosion- and marine life-inhibiting protective fluid. Flushing of the chamber, for example when the inside of the chamber must be clear for monitoring remote repair operations or the like, is achieved by introducing sea water or the like through a flushing port outlet disposed outside the chamber adjacent to the chamber lid into a pipe which extends down the inside of the chamber and has an outlet near the chamber bottom. Flushing displaces the protective fluid into the dracon and leaves the sea water in its place. The sea water can likewise be displaced with more protective fluid pumped from the surface when the repairs are completed.

An anchoring means such as a matrix of steel chain may be provided which covers the dracon loosely when deflated and holds the dracon in place but permits it to expand and fill when necessary.

A pop-off lid cap with attached expandable pressure-containing conduit may also be disposed on top of the protective enclosure. When the dracon has reached its capacity and operators have not had an opportunity to remove and replace the dracon or otherwise relieve the pressure from the leaking well fluids, e.g. by attachment to a remote tanker or the like, the pop-off lid cap is released from the protective enclosure and the expandable conduit is permitted to deploy. Additional leaking well fluids are contained in the expandable conduit as it is deployed. It is preferred that a sufficient length of expandable conduit be used to permit the pop-off lid cap to reach the surface of the water. Of course, this may not be possible for deep-water wells. When the expandable conduit has reached its capacity, preferably with the pop-off cap at the surface of the water, and operators have not had an opportunity to reach the leaking well site to retrieve and access the expandable conduit, the pop-off lid cap is released from the expandable conduit. Thereafter, leaking well fluids will be released into the environment, but by then such release has been delayed to provide operators with some lead time in traveling to the leaking well site to rectify the situation.

BRIEF DESCRIPTION OF THE DRAWINGS

These and other advantages of the present invention will be apparent from the following detailed description, taking into account the foregoing discussion, and read in conjunction with reference to the following drawings wherein.

DETAILED DESCRIPTION OF THE PREFERRED EMBODIMENT OF THE INVENTION

Figure 1:
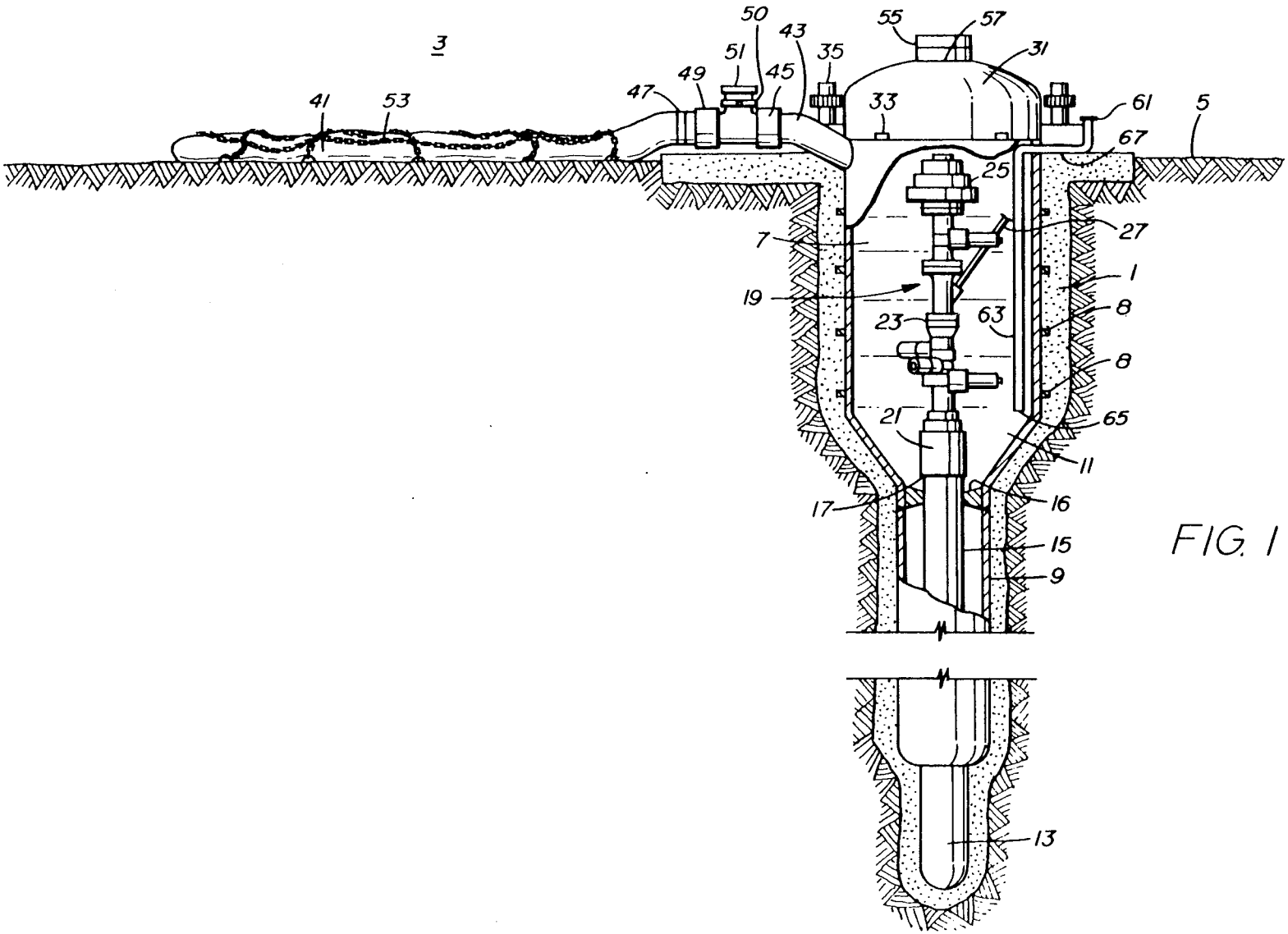
FIG. 1 is a view in elevation, partly fragmentary, partly in section and with some parts broken away, of an environmentally-protected subsea well apparatus according to the invention installed on the ocean floor with the dracon deflated.
Figure 2:
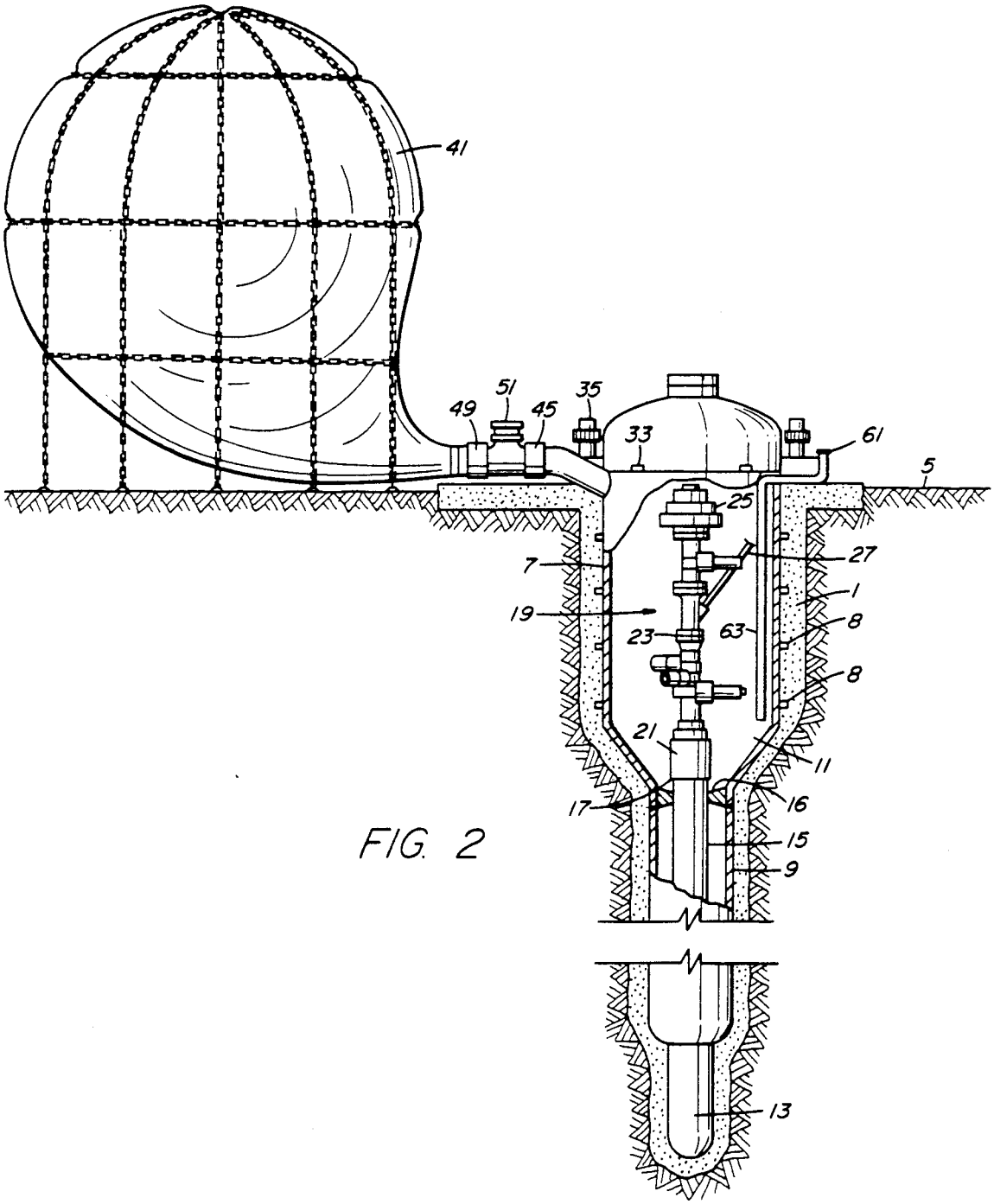
FIG. 2 is a view similar to FIG. 1 with the dracon filled with fluid.

Referring to FIGS. 1 and 2, there is shown an enclosed protective chamber, indicated generally at 1, disposed on the bottom of the sea 3 and extending below the mudline 5. Protective chamber 1 includes an elongated main body 7 of substantially hollow cylindrical configuration which may be drilled, driven, jetted, or washed into the sea floor 5. Main body 7 includes a plurality of ribs 8 spaced apart around its exterior periphery for providing stability and rigidity to the main body 7 and assisting in the process of installing the chamber in the sea floor. Protective chamber 1 is made of steel or other materials compatible with conventional subsea wellhead installations. A conductor guide casing 9 attached to the frustoconical-shaped bottom 11 of main body 7, as by welding, is installed along with main body 7. Conductor guide casing 9 may extend a substantial distance, for example several hundred feet or more, below the bottom of protective chamber 1 into the seabed.

A well 13 is drilled from a platform or vessel above the protective chamber 1, through the bottom 11 of the main body 7 and down through the conductor guide casing 9. The upper portion of the well is drilled, and surface casing 15 is landed in the bottom of main body 7 through annular centralizer 16 and is cemented into place. At the upper portion of the surface casing 15 there is located a casing hanger shoulder 17 for landing and orienting other casing and tubing, as desired, in telescoping relation with the surface casing. The well is completed by the installation of a wellhead assembly illustrated generally at 19 including a wellhead body 21, a Christmas tree assembly 23, and a valve control system 25 for selectively operating the valves of the Christmas tree assembly 23. The Christmas tree valves are actuated by a remotely controllable power operator to control the flow of fluid through the Christmas tree production conduit structure, which includes at least one production conduit 27 extending from the Christmas tree 23 to an appropriate storage or fluid handling facility for petroleum products being produced by the well.

Figure 5:
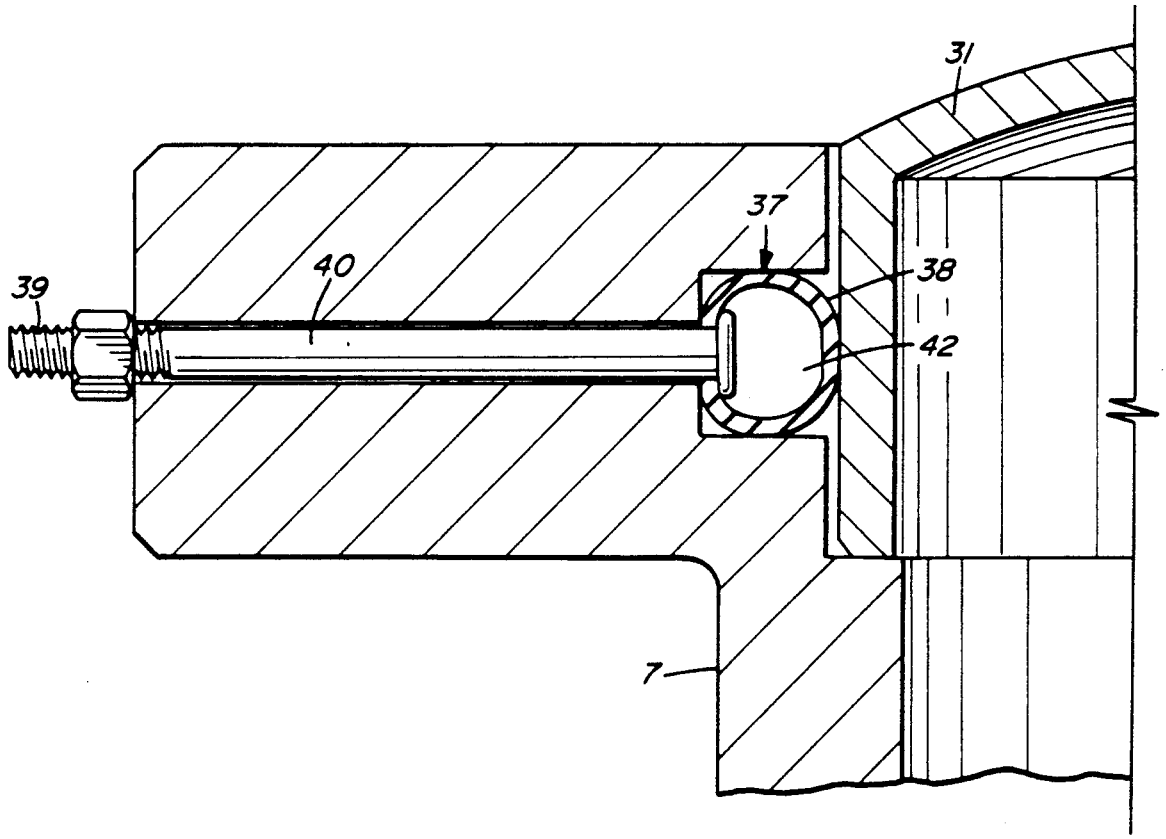
FIG. 5 is an enlarged, fragmentary view of an inflatable seal which may be used to seal around the lid of the protective chamber.
Figure 7:
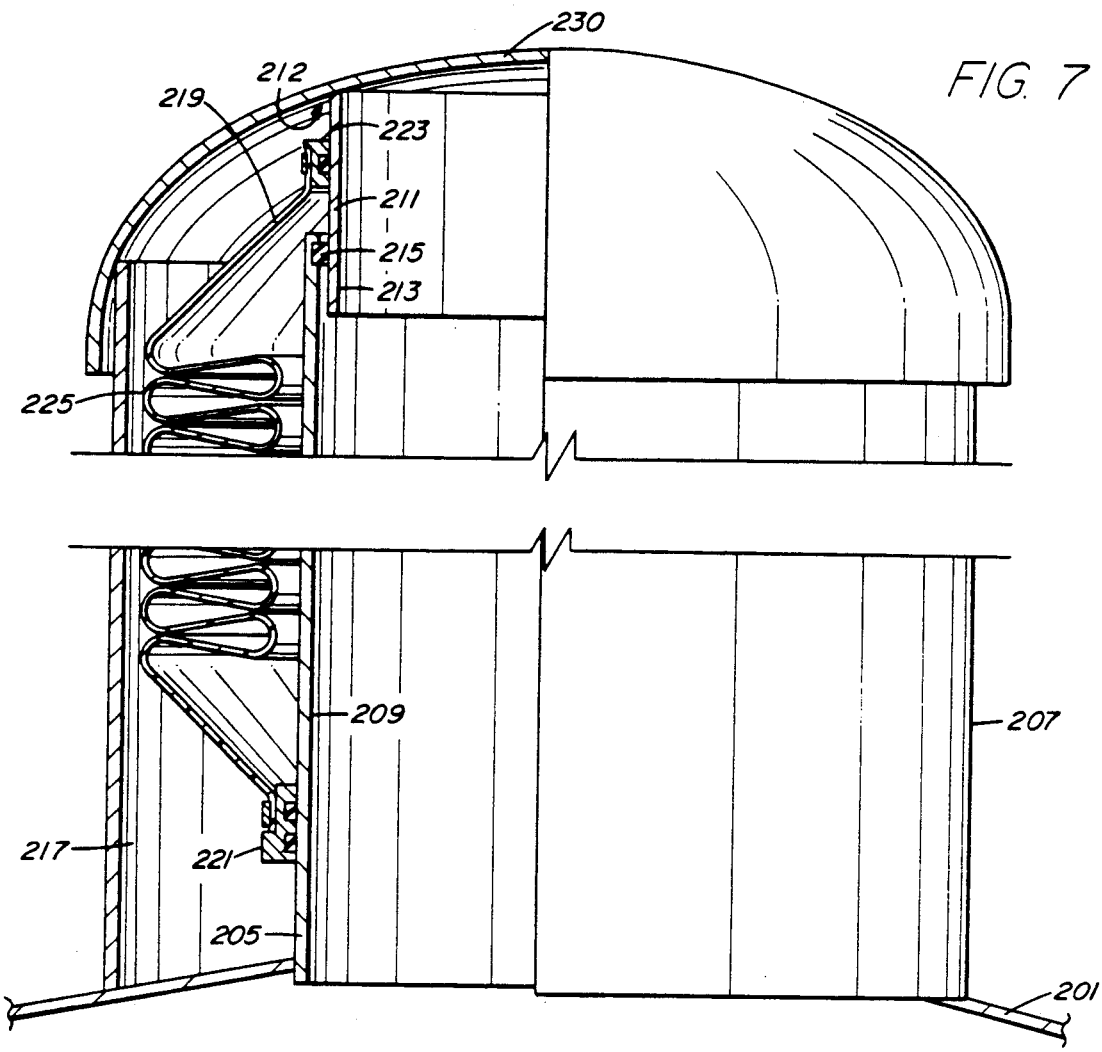
FIG. 7 is an enlarged, fragmentary, sectional view of the pop-off lid cap of the protective chamber shown in FIG. 6.
Figure 6:
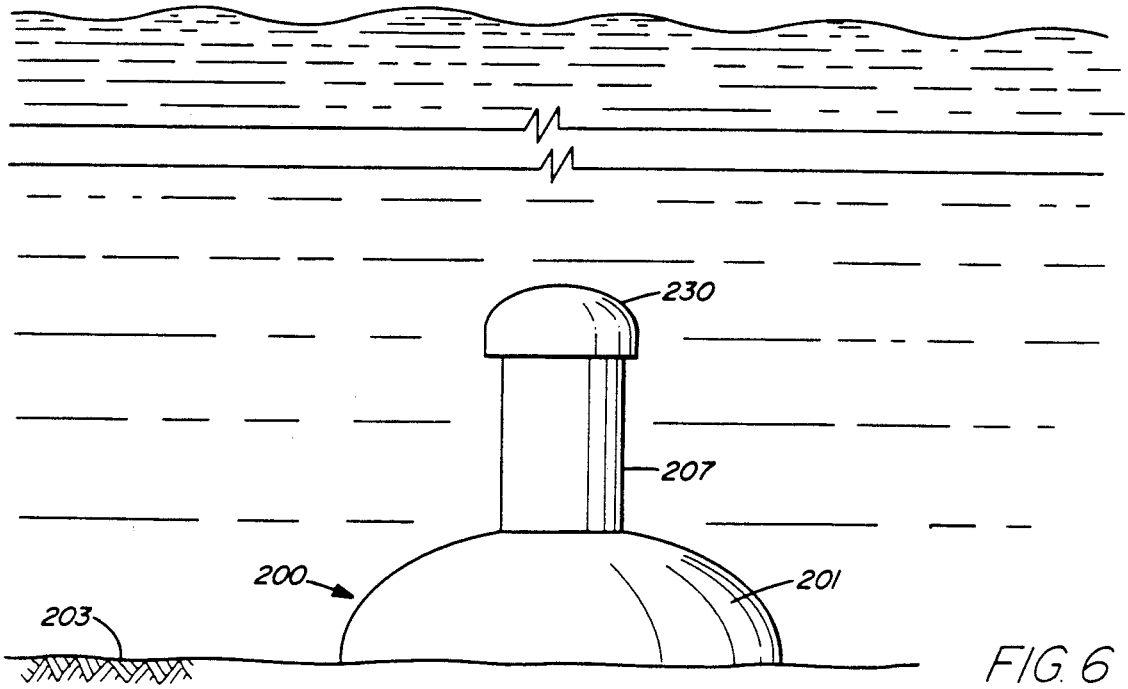
FIG. 6 is an elevational view of a lid of a subsea protective chamber incorporating a pop-off lid cap of the present invention.

After the well has been completed and the wellhead assembly has been installed, a pressure-containing lid 31 is secured in place on top of main body 7, for example by L-shaped lugs 33 disposed on the lid 31 or the main body 7, which are received in correlatively-shaped slots in the other member. One or more hydraulic locking devices 35 secure the lid 31 onto the main body 7. An inflatable seal 37 (FIG. 5) located between the top lid 31 and the main body 7, when inflated, seals internal pressure inside of chamber 1 from the hydrostatic head of the surrounding sea water. Inflatable seal 37 may be, for example, a hose-like annular member 38 of rubber or other suitable elastomer. A valve 39 includes a stem 40 which communicates the interior 42 of seal member 38 with the exterior of main body 7 for access to a source of compressed air or the like (not shown) for inflating seal member 38.

An inflatable, elongated, flexible storage tank or dracon 41 of plastic, neoprene, or other tough, durable, sea water and petroleum and chemical impervious material is attached to the protective enclosure or chamber 1 through a fluid carrying conduit 43 incorporating a pressure-balanced relief valve 45 therewithin. Relief valve 45 prevents fluid from entering dracon 41 under normal operating conditions when pressure inside of chamber 1 is not abnormally elevated.

Dracon 41 is attached to conduit 43 preferably via a quick disconnect-type coupling 47. A closure valve 49 is disposed in conduit 43 between pressure relief valve 45 and dracon 41. Valve 49 is adapted to be opened when quick disconnect coupling 47 is engaged, and closed upon release of coupling 47. The quick disconnect 47 and closure valve 49 enable fast and ready attachment, removal, or replacement of the dracon, e.g., when dracon 41 is filled. One or more additional outlets 51 may be provided in the conduit 43 to permit coupling to a tanker or other facility on the surface, for example, or to accommodate one or more additional dracons 41 for simultaneous filling.

Under normal operating conditions, dracon 41 is deflated, and may be outstretched on the sea floor adjacent to the chamber 1. Alternatively, dracon 41 may be rolled or folded up, somewhat like an empty fire hose or inflatable life raft would be kept in storage. An anchoring means, such as a matrix of steel chain 53, may be provided which covers dracon 41 and anchors it in place in the sea floor, but permits the dracon to expand in order to fill when necessary.

In the event of a leak developing from the subsea wellhead assembly 19, a pressure buildup within chamber 1 allows surplus fluid to be communicated to dracon 41 through the conduit 43, pressure relief valve 45, closure valve 49, and quick disconnect 47. When dracon 41 is filled as shown in FIG. 2, it may be disconnected from the conduit and removed to the surface, after release or removal of any anchoring means such as steel chain 53, for retrieval or disposal, as desired, of the fluid contents. Dracon 41 is designed with a pressure-containing capability sufficient to meet expected demands in service. Closure valve 49 prevents release of well or chamber fluids into the sea during the interim between removal of a dracon and its reinstallation or replacement. Similarly, a closure valve 50 at additional outlet 51 prevents release of fluids through that outlet if there is no dracon attached thereto, or if a connection to a surface facility, such as a tanker, has not been made.

A connection 55 on top of lid 31 permits attachment of a riser pipe from chamber 1 to a vessel or fixed structure at the surface prior to opening a wireline access hatch 57. When the riser pipe has been attached and the hatch 57 opened, wireline or other operations may proceed through the riser and hatch.

The interior of chamber 1 under normal operating conditions is filled with a corrosion-inhibiting and marine life-inhibiting protective fluid, such as fresh water, which may contain appropriate additives. After extended periods of use, the protective fluid may become murky or cloudy, making remote repair operations or the like difficult where some form of visual monitoring is required. In order to clear chamber 1 for facilitating such monitoring, or for any other reason, the chamber may be flushed by introducing sea water or the like into the chamber through a flushing port outlet 61 disposed outside the chamber adjacent to the lid 31. A pipe 63 is disposed inside of chamber 1 and extends down the inside wall of main body 7 and has an opening 65 near the bottom of the chamber. An exterior flush pipe 67 communicates pipe 63 to outlet 61 through the chamber wall. Sea water enters the bottom of chamber 1 through outlet 65, having been communicated from outlet 61, through pipes 67 and 63. Flushing displaces the protective fluid into the dracon and leaves the sea water or the like in its place. The protective fluid in the dracon can be retrieved for filtering or other recovery procedures and then reused, or disposed of. The sea water can likewise be displaced from the chamber with the recovered protective fluid, or with entirely new protective fluid, pumped from the surface when the repairs or other operations are completed.

Figure 3:
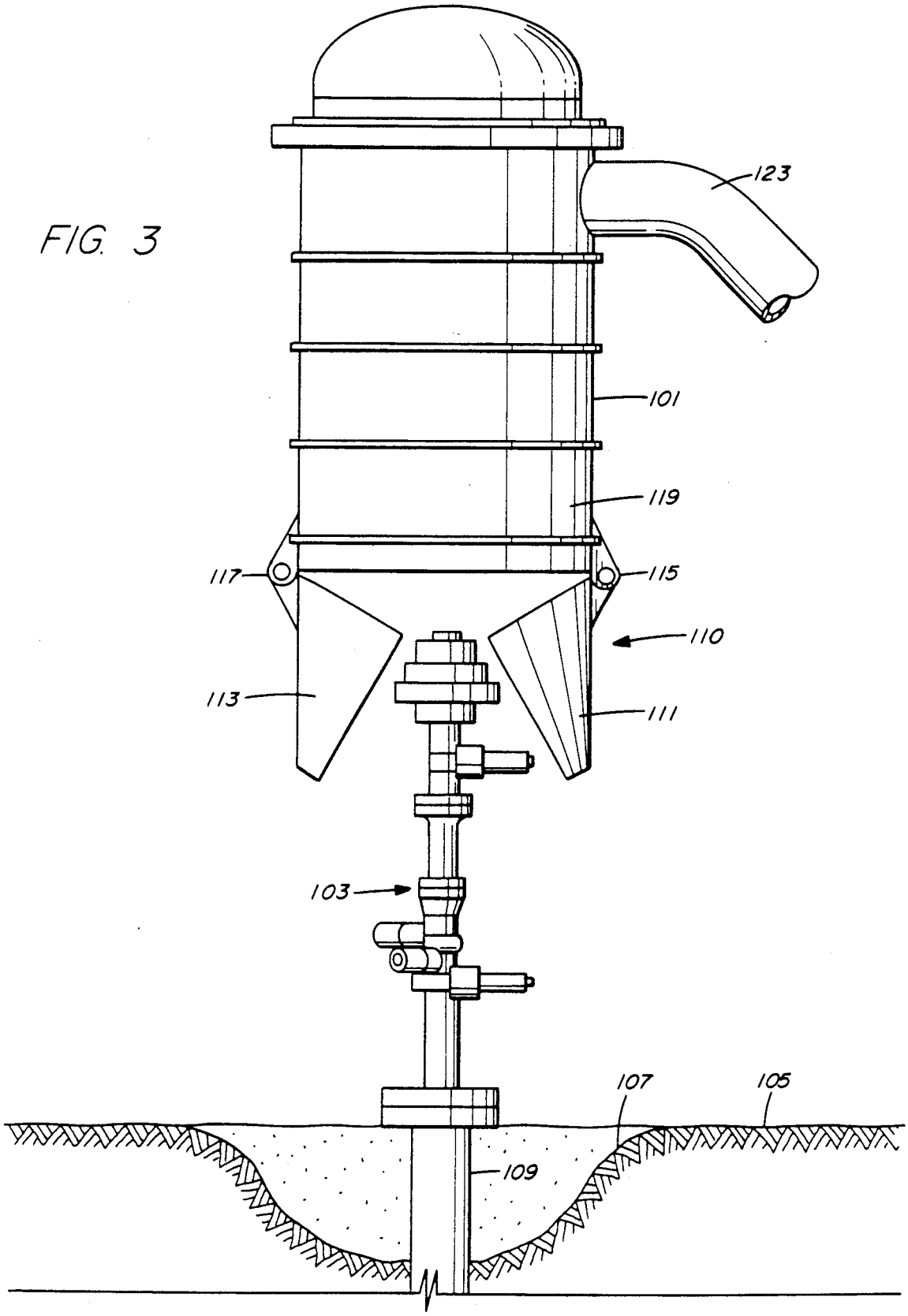
FIG. 3 is an elevational view showing a protective chamber being lowered over an existing Christmas tree structure on a subsea well.
Figure 4:
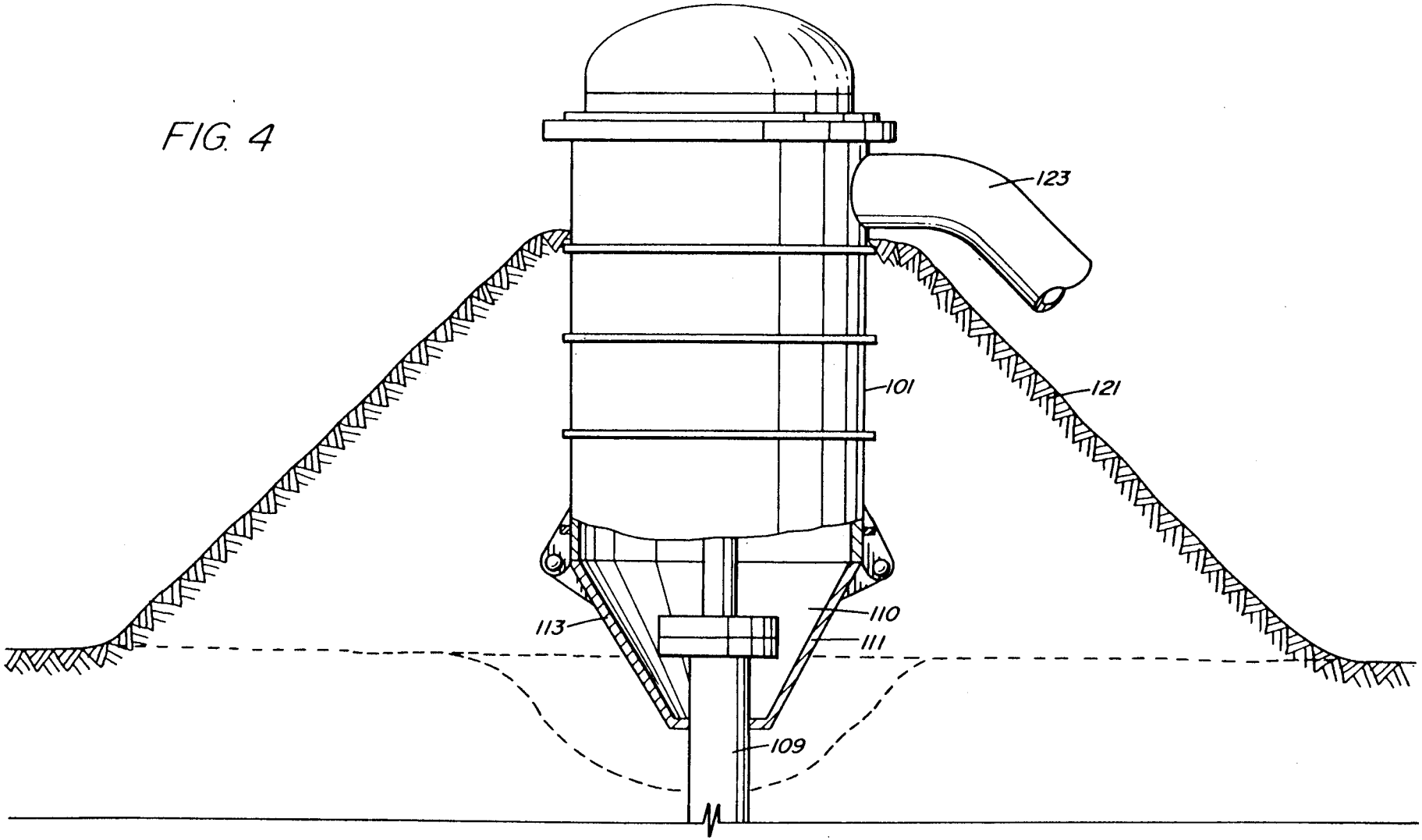
FIG. 4 is an elevational view showing the protective chamber of FIG. 3 installed around the existing subsea Christmas tree structure, with a berm constructed around the protective chamber.

Referring to FIGS. 3 and 4, an alternative embodiment of a protective chamber 101 is shown being lowered over an existing subsea wellhead structure 103 protruding from the sea floor 105. Prior to lowering chamber 101 onto wellhead structure 103, the sea floor is preferably excavated, as shown at 107, around the casing 109 to facilitate installation of the chamber. The bottom 110 of chamber 101 comprises a pair of frustoconical-shaped, semicircular halves 111, 113 which are hinged at 115, 117, respectively, to main body 119 of chamber 101. When chamber 101 is lowered onto wellhead 103, hinged bottom portions 111, 113 are expanded outwardly, permitting chamber 101 to pass downwardly over the wellhead components. When chamber 101 has been landed, bottom portions 111, 113 are rotated inwardly toward one another and affixed in place around casing 109. An inflatable seal or other suitable sealing means (not shown) is disposed between the upper rims of the bottom portions 111, 113 and the lower face of the main body 119.

When the bottom 110 of chamber 101 is installed around casing 109, excavation 107 is filled in (FIG. 4). A protective berm 121 of mud, shell, or other suitable material is then constructed around chamber 101 through conventional techniques. Berm 121 serves to stabilize and protect the chamber 101 around wellhead 103. A fluid carrying conduit 123 is affixed to the upper portion of main body 119. Conduit 123 extends to the sea floor and is provided with a pressure-balanced relief valve, a closure valve, and a quick disconnect-type coupling like those described above for attaching a dracon, again like that described above, to chamber 101. Operation of the dracon then proceeds as described above in connection with the embodiment shown in FIGS. 1 and 2.

Referring to FIGS. 6–9, a pop-off lid cap and expandable conduit for an underwater protective chamber are shown. The pop-off lid cap and expandable conduit of FIGS. 6–9 may be employed with the protective chambers shown in FIGS. 1–4; however, details of those chambers and their leakage containment structures have been eliminated for simplification purposes.

Protective chamber lid 201 of chamber 200 on sea floor 203 includes an elongate sleeve 205 connected to and extending upwardly from the upper central portion of lid 201. An outer stack 207 is disposed concentrically around sleeve 205 and is affixed to the outer wall surface of lid 201. The bore 209 of sleeve 205 communicates with the interior of lid 201 and chamber 200. An inner extension sleeve 211 is concentrically disposed within and releasably attached to the inside diametral walls of sleeve 205. Inner extension sleeve 211 protrudes upwardly from the upper end of sleeve 205. The bore 213 of extension sleeve 211 is coaxial with, and communicates with, bore 209 of sleeve 205. Pressure-actuated releasable connection 215 attaches extension sleeve 211 to sleeve 205 and is adapted to release sleeve 211 from sleeve 205 when fluid pressure in bores 209, 213 reaches a predetermined value. For example, when a dracon according to the present invention has been filled and fluid pressure in chamber 200 continues to increase due to leakage, releasable connection 215 is actuated to release sleeve 211 at a predetermined pressure value before the fluid pressure increases to a level which could rupture the dracon or chamber seals or otherwise cause a leak from the chamber.

Figure 8:
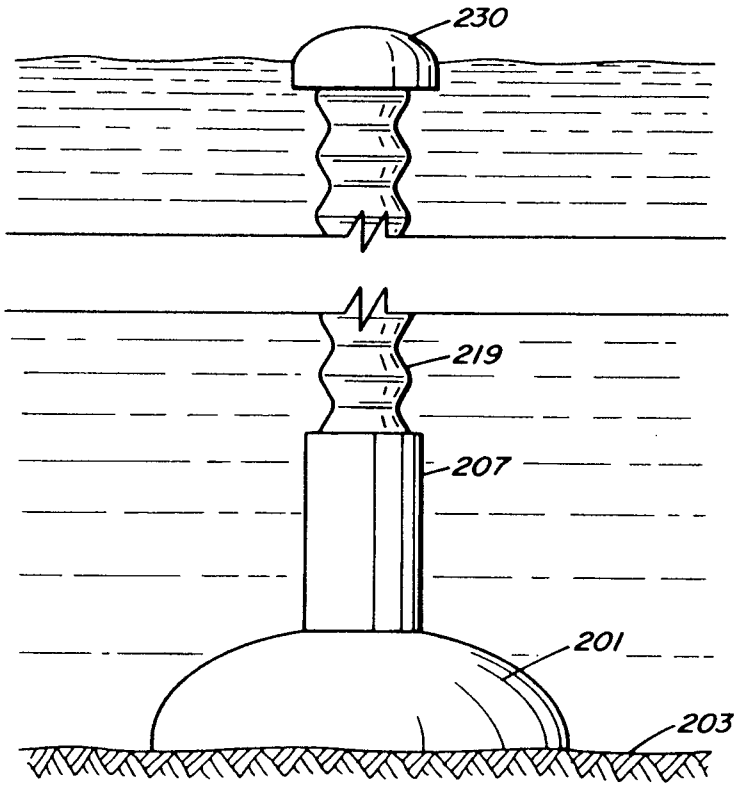
FIG. 8 is an elevational view of the apparatus of FIGS. 6 and 7, with the pop-off lid cap released from the protective chamber and floating on the water's surface, and the expandable conduit deployed.

In the annulus 217 between sleeves 205, 211 and stack 207, there is disposed an expandable conduit 219 affixed at one end to the outside wall of sleeve 205 near lid 201, and at its other end to the outside wall of extension sleeve 211 near its upper end. Attachment means 221 sealingly affixes the lower end of conduit 219 to sleeve 205, and attachment means 223 sealingly affixes the upper end of conduit 219 to extension sleeve 211. Conduit 219 preferably comprises a convoluted flexible tube having a plurality of serpentine folds 225 such that it may expand in accordion-like fashion when deployed. Release of connection 215 releases sleeve 211 from sleeve 205 and permits deployment of conduit 219. Conduit 219 is preferably made of a tough, flexible, corrosion agent-impervious material capable of withstanding fluid pressures expected to be encountered in service. A material like the one used for dracon 41, for example, may be suitable for conduit 219. It is preferred that a sufficient length of conduit 219 be used such that when deployed its upper end reaches the water's surface. FIG. 8 illustrates such deployment of conduit 219. It should be understood, however, that for deep-water wells this may not be possible.

Figure 9:
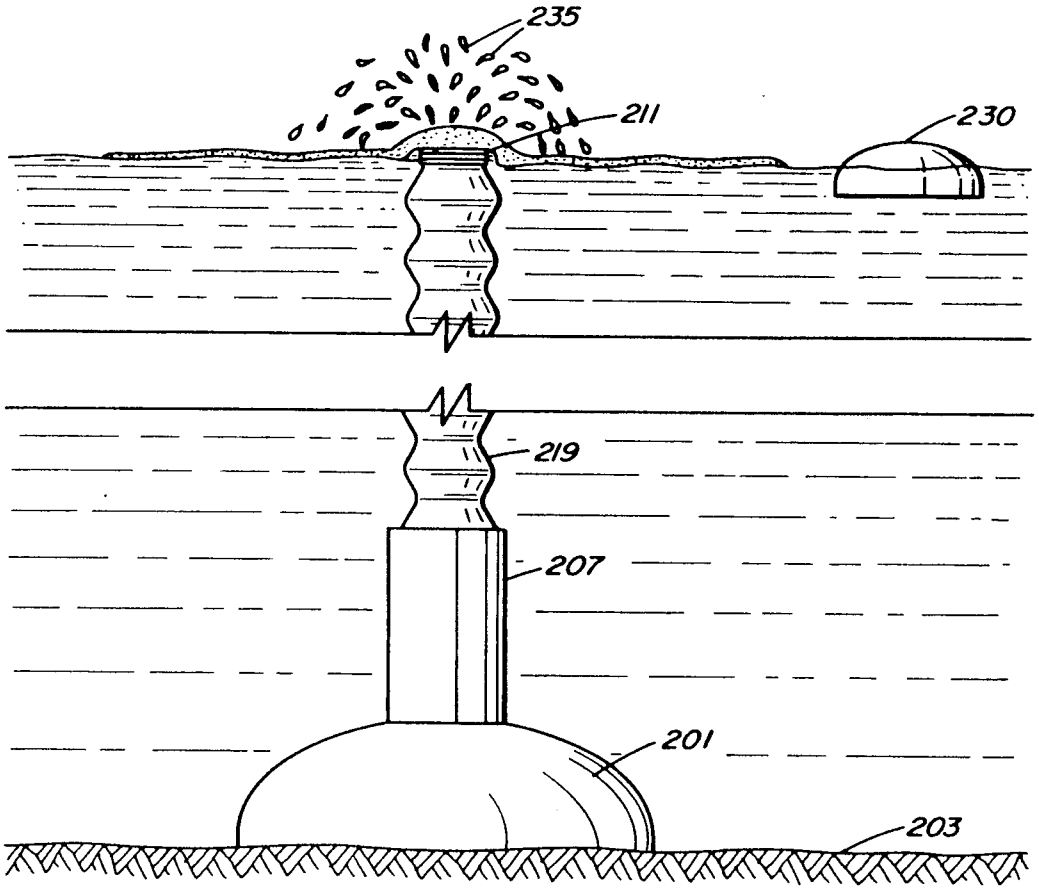
FIG. 9 is a view similar to FIG. 8, with the pop-off lid cap released from the expandable conduit and petroleum products beginning to be released into the environment.

At the upper end of extension sleeve 211 there is disposed a floatable, pop-off lid cap 230. Lid cap 230 is releasably and sealingly attached to sleeve 211 at 212, such as by a light weld, such that cap 230 is released from sleeve 211 after full deployment of conduit 219 when the pressure inside the bore 213, i.e., the pressure inside conduit 219, reaches a predetermined value. FIG. 9 shows lid cap 230 floating on the surface of the water after being released from sleeve 211. Release of cap 230 from the upper end of conduit 219 permits leaking well fluids to be released into the sea, as shown at 235 in FIG. 9. Release of cap 230 is delayed, however, until the last moment, when there is a danger of rupturing conduit 219. Care should be exercised to ensure that lid cap 230 is not released prior to full deployment of conduit 219. This delay in releasing pop-off cap 230 is intended to provide operators an opportunity to arrive at the leaking well site and to retrieve and safely access the conduit 219 without releasing well fluids to the environment. If the conduit 219 is long enough, cap 230 will preferably be on the water's surface when the operators arrive, thus facilitating location and retrieval of the conduit. In the event that operators cannot reach the well in time to retrieve the conduit prior to release of cap 230, at least the spilling petroleum products will be disposed at or near the surface of the water, and not at the sea floor. This would aid greatly in attempting to retrieve or clean the leaked product from the sea.

While preferred embodiments of the invention have been shown and described, many modifications thereof may be made by those skilled in the art without departing from the spirit of the invention. Accordingly, the scope of the invention should be determined in accordance with the following claims.

We claim:

1. Apparatus for receiving and containing surplus fluid from a subsea well installation on the ocean floor including a subsea wellhead assembly disposed in an enclosed protective chamber, comprising:

a fluid-carrying conduit connected to the exterior of said protective chamber in fluid communication with the interior of said protective chamber;

an inflatable dracon disposed upon and against the ocean floor in protective relation thereto when deflated and releasably connected in fluid communication to an outlet of said conduit; and pressure-balanced relief valve means disposed in said conduit between said outlet and said protective chamber for communicating surplus fluid from the interior of such chamber to said dracon when the fluid pressure within such chamber exceeds a predetermined value.

2. Apparatus according to claim 1, wherein said dracon is made of a tough, durable, flexible material which is relatively impervious to sea water, petroleum, and chemicals.

3. Apparatus according to claim 2, wherein said dracon is made of neoprene.

4. Apparatus according to claim 2, wherein said dracon is made of a plastics material.

5. Apparatus according to claim 1, wherein said dracon is releasably anchored to the sea floor.

6. Apparatus according to claim 1, wherein said dracon is releasably anchored to the sea floor under a mesh of steel chain.

7. Apparatus according to claim 1, wherein said dracon is attached to said conduit through a quick disconnect-type coupling.

8. Apparatus according to claim 1, and further including closure valve means disposed in said conduit between said outlet and said pressure-balanced relief valve means for permitting passage of surplus fluid through said outlet into said dracon when said dracon is connected to said conduit, and for preventing release of said surplus fluid from said outlet into the sea when said dracon is released from said conduit.

9. Apparatus according to claim 1, and further including a second outlet on said conduit adapted for releasably attaching a second inflatable dracon or a riser pipe to said conduit at said second outlet, said pressure-balanced relief valve means being disposed between said second outlet and said protective chamber.

10. Apparatus according to claim 1, wherein said protective chamber includes a main body of substantially hollow cylindrical configuration and a pressure-containing lid sealingly mounted on top of said main body for isolating the interior of said chamber from the hydrostatic head of the surrounding sea water.

11. Apparatus according to claim 10, wherein said lid is releasably retained on said main body by lugs disposed on one of said lid and said body, received in correlatively-shaped slots in the other of said lid and said body.

12. Apparatus according to claim 11, and further including hydraulic locking means disposed between said lid and said body for releasably locking said lid on said body.

13. Apparatus according to claim 10, and further including an inflatable seal disposed between said lid and said body for effecting a seal between said lid and said body when inflated.

14. Apparatus according to claim 10, wherein said conduit is attached to the upper end portion of said main body, and further including a flush pipe having one end disposed inside said main body near the bottom of said main body and its other end disposed outside said main body, said flush pipe being adapted for introducing flushing fluids into the bottom of said chamber and displacing the fluid contents of said chamber up and out through said conduit into said dracon.

15. Apparatus according to claim 10, and further including an access hatch disposed on said lid for permitting access to the interior of said chamber when opened, and riser connection means disposed on said lid around said access hatch for attaching a riser pipe to said lid prior to opening said access hatch.

16. Apparatus according to claim 10, wherein said protective chamber is installed substantially entirely below the mudline.

17. Apparatus according to claim 10, wherein said protective chamber is installed around wellhead structure protruding upwardly from the sea floor.

18. Apparatus according to claim 1, wherein said inflatable dracon lies substantially entirely upon and flat against the ocean floor in elongate condition when deflated.

19. Apparatus according to claim 1, wherein said inflatable dracon is substantially rolled or folded up when deflated.

20. Apparatus for receiving and containing surplus fluid from a subsea well installation on the ocean floor including a subsea wellhead assembly disposed in an enclosed protective chamber, said protective chamber being installed around wellhead structure protruding upwardly from the ocean floor and including a main body of substantially hollow cylindrical configuration and a pressure-containing lid sealingly mounted on top of said main body for isolating the interior of said chamber from the hydrostatic head of the surrounding sea water, comprising:

a fluid-carrying conduit connected to the exterior of said protective chamber in fluid communication with the interior of said protective chamber;

an inflatable dracon releasably connected in fluid communication to an outlet of said conduit; and pressure-balanced relief valve means disposed in said conduit between said outlet and said protective chamber for communicating surplus fluid from the interior of such chamber to said dracon when the fluid pressure within such chamber exceeds a predetermined value, said protective chamber including a frustoconical-shaped bottom portion having mating halves, each of said halves being hingedly connected to said main body of said protective chamber such that said halves are permitted to rotate outwardly, opening said bottom portion and allowing said protective chamber to be lowered over said protruding wellhead structure, and inwardly, closing said bottom portion about the well casing when said protective chamber has been landed.

21. Apparatus for receiving and containing surplus fluid from a subsea well installation on the ocean floor including a subsea wellhead assembly disposed in an enclosed protective chamber, comprising:

a fluid-carrying conduit connected to the exterior of said protective chamber in fluid communication with the interior of said protective chamber;

an inflatable dracon releasably connected in fluid communication to an outlet of said conduit; and pressure-balanced relief valve means disposed in said conduit between said outlet and said protective chamber for communicating surplus fluid from the interior of such chamber to said dracon when the fluid pressure within such chamber exceeds a predetermined value, and further including expandable containment means disposed on said lid for containing additional surplus fluid from the interior of the chamber when said dracon has been filled.

22. Apparatus according to claim 21, wherein said expandable containment means includes:

an elongate sleeve affixed to said lid and having a bore in fluid communication with the interior of said protective chamber;

an extension sleeve disposed within and releasably connected to said elongate sleeve, said extension sleeve protruding from the upper end of said elongate sleeve and having a bore in fluid communication with said bore of said elongate sleeve;

the connection between said elongate sleeve and said extension sleeve being adapted for releasing said extension sleeve from said elongate sleeve when the fluid pressure within said bores reaches a second predetermined value greater than said first predetermined value; and flexible conduit means attached at one end to the outer wall of said elongate sleeve and at the other end to the outer wall of said extension sleeve.

23. Apparatus according to claim 22, wherein said flexible conduit means comprises a tubular member having a plurality of serpentine folds, said member being expandable accordion-style.

24. Apparatus according to claim 22, and further including a pop-off cap releasably connected to the upper end of said extension sleeve, the connection between said pop-off cap and said extension sleeve being adapted for releasing said pop-off cap from said extension sleeve when the fluid pressure within said bores reaches a third predetermined value greater than said second predetermined value.

25. A method of completing an underwater well, comprising the steps of:

installing a hollow cylindrical silo body with attached conductor guide casing into the sea floor;

drilling and casing a well through the silo body and conductor guide casing;

installing a wellhead assembly on top of the drilled and cased well inside of the silo body;

installing a pressure-containing lid on top of the silo body, forming an enclosed protective chamber and isolating the interior of the chamber from the surrounding hydrostatic head of the sea water;

releasably attaching an inflatable dracon through a fluid-carrying conduit to the interior of the chamber, said inflatable dracon being disposed upon and against the ocean floor in protective relation thereto when deflated;

installing pressure-balanced relief valve means in the fluid-carrying conduit between the dracon and chamber, said relief valve means being adapted for releasing surplus fluid from the chamber into the dracon when the chamber pressure exceeds a predetermined value; and filling the chamber with a corrosion- and marine life-inhibiting protective fluid at a pressure below said predetermined value.

26. A method of protecting the environment from leakage from a subsea well, comprising the steps of:

installing a hollow cylindrical pressure-containing silo around the wellhead structure of the subsea well;

releasably attaching an inflatable dracon through a fluid-carrying conduit to the interior of the silo, said inflatable dracon being disposed upon and against the ocean floor in protective relation thereto when deflated;

installing pressure-balanced relief valve means in the fluid-carrying conduit between the dracon and silo, said relief valve means being adapted for releasing surplus fluid from the silo into the dracon when the silo pressure exceeds a predetermined value; and filling the silo with a corrosion- and marine life-inhibiting protective fluid at a pressure below said predetermined value.

* * * * *